US010539341B2

(12) United States Patent
Lilie et al.

(10) Patent No.: US 10,539,341 B2
(45) Date of Patent: Jan. 21, 2020

(54) MULTI-EVAPORATION COOLING SYSTEM

(71) Applicant: Whirlpool S.A., Sao Paulo (BR)

(72) Inventors: Dietmar Erich Bernhard Lilie, Joinville (BR); Gustavo Portella Montagner, Joinville (BR)

(73) Assignee: Embraco—Industria De Compressores E Solucoes EM Refrigeracao LTDA., Joinville (BR)

( * ) Notice: Subject to any disclaimer, the term of this patent is extended or adjusted under 35 U.S.C. 154(b) by 0 days.

(21) Appl. No.: 15/265,108

(22) Filed: Sep. 14, 2016

(65) Prior Publication Data

US 2017/0074549 A1 Mar. 16, 2017

(30) Foreign Application Priority Data

Sep. 15, 2015 (BR) ..... 10 2015 023711

(51) Int. Cl.

| | |
|---|---|
| ***F25B 5/02*** | (2006.01) |
| ***F25B 41/00*** | (2006.01) |
| *F25B 41/06* | (2006.01) |

(52) U.S. Cl.

CPC ..... *F25B 5/02* (2013.01); *F25B 41/003* (2013.01); *F25B 41/067* (2013.01); (Continued)

(58) Field of Classification Search

CPC ..... F25B 5/02; F25B 41/003; F25B 41/067; F25B 2400/054; F25B 2400/075; (Continued)

(56) References Cited

U.S. PATENT DOCUMENTS 4,193,270 A * 3/1980 Scott ..... F25B 1/00 62/175
2005/0198997 A1* 9/2005 Bush ..... F25B 1/10 62/513

(Continued)

FOREIGN PATENT DOCUMENTS

WO WO-2011/134030 A2 11/2011

OTHER PUBLICATIONS

Plant Engineering, "Rotary screw or reciprocating air compressors: Which one is right?", p. 1-3, Apr. 8, 2002.*

(Continued)

*Primary Examiner* — Edward F Landrum
*Assistant Examiner* — Daniel C Comings
(74) *Attorney, Agent, or Firm* — Harrington & Smith

(57) ABSTRACT

A multiple-evaporation cooling system in which the intermediate heat exchanger of first evaporation line includes at least a segment of the physically arranged expansion device in contact with at least a portion of the second row of evaporation and the intermediate heat exchanger's second evaporative line includes at least one expansion device segment physically disposed in contact with at least one portion of a first evaporation line. Considering the temperature of the intermediate heat exchanger of first evaporation line influences the temperature of the refrigerant flowing in the second line of evaporative expansion device and the temperature of the intermediate heat exchanger of the second evaporative line influences the temperature of the refrigerant flowing in the first line of evaporative expansion device. Features include varying the restriction of the respective expansion devices and then unduly inhibit mass transfer of refrigerant between at least two distinct evaporation.

3 Claims, 5 Drawing Sheets

(52) U.S. Cl.
CPC ..... *F25B 2313/02331* (2013.01); *F25B 2313/02531* (2013.01); *F25B 2400/054* (2013.01)

(58) Field of Classification Search
CPC ..... F25B 2400/13; F25B 2500/05; F25B 2313/02331
See application file for complete search history.

(56) References Cited

U.S. PATENT DOCUMENTS

2006/0179858 A1* 8/2006 Yoshioka ..... F25B 1/10 62/203
2015/0192341 A1* 7/2015 Li ..... F25B 47/02 62/441

OTHER PUBLICATIONS

Bright Hub Engineering, "Capillary Tube for Refrigeration and Air Conditioning Systems", p. 1-4, Dec. 4, 2009.*

* cited by examiner

MULTI-EVAPORATION COOLING SYSTEM

FIELD OF THE INVENTION

The subject invention relates to a multi-evaporation cooling system i.e. a cooling system provided with at least two functionally separate evaporators, which operate at different temperature ranges and pressure.

More specifically, the subject invention relates to an integrated multi-evaporation cooling system further by internal heat exchangers, which are arranged crosswise, i.e., each of the internal heat exchanger is positioned so as to cool the refrigerant fluid of a distinct and different evaporation line is the same that belongs.

BACKGROUND OF THE INVENTION

As is known to those versed skilled in the art, cooling systems conventionally comprise a compressor, a condenser through an expansion device and an evaporator. These components are fluidly connected to each other so as to define a circuit for the circulation of a refrigerant fluid which is able to change state and temperature throughout the cooling system. All functional dynamics of a conventional cooling system is widely known by technicians skilled in the art, and is widely disclosed in the specialized technical literature.

It is also known to the skilled technicians in the art that certain conventional cooling systems, like those used in domestic refrigerators comprise a traditional arrangement wherein the expansion device it is a capillary tube, physically arranged in contact (welded or rolled up) to the outlet pipe of the evaporator, acting as a heat exchanger.

The general principle of this arrangement is to optimize the efficiency of the cooling system through forced cooling of the refrigerant flowing in the expansion device, which provides a reduced restriction to flow, an increase of the specific refrigerating effect and the resulting increased the system cooling capacity.

As is known to those versed skilled in the art, this traditional arrangement shown functional by the fact that the temperature of the refrigerant leaving the evaporator is lower than the temperature of the refrigerant leaving the condenser and is directed to the device expansion. Thus, the physical contact between the capillary and the evaporator outlet pipe (internal heat exchanger) creates conditions to cool the refrigerant flowing into the capillary tube.

On the other hand, they are also known multiple evaporative cooling systems, or integrated cooling systems at least one compressor, at least one condenser, at least two devices of expansion and at least two evaporators which operate so independently at different temperature ranges and pressure. The functional dynamics of this type of cooling system is extremely functional dynamics similar to conventional cooling systems.

In general, the constructive options and the application possibilities of multiple evaporative cooling systems are vast and already well explored in patent documents.

From the constructive viewpoint, PCT/BR2011/000120 describes, for example, a double evaporation cooling system specially built for a reciprocating compressor with double suction provided with two suction inlets on a single compression chamber, or an integrated dual evaporator cooling system in a conventional reciprocating compressor further comprising an additional way, a single fluid selector device, in particular a selector arranged fluids coming from the two evaporation lines. Both compressors provided in PCT/BR2011/000120 enable the construction of a multiple evaporative cooling system.

A typical instantiation of a multi-evaporation cooling system is illustrated in FIG. 1.

Such a system is fundamentally comprised of a double suction reciprocating compressor COMP, by a condenser COND and a feeder AL which extend two evaporation lines.

The first evaporation line is composed of a capillary tube (PDE which defines a first internal heat exchanger PTCI) and a first evaporator PEVAP. Similarly, the second evaporation line is composed of capillary tube SDE (that defines a second internal heat exchanger STCI) and a second evaporator SEVAP.

Of course, the operating principle of each line and evaporation is analogous to the functional principle of a conventional cooling system formed by a traditional arrangement as described above.

It happens, however, that when this traditional arrangement is emulated on a multi-evaporation cooling system, serious problems may occur and, more particularly, serious problems may occur when observing a large increase in thermal load on only one of the evaporators.

This is because, as is known to those versed skilled in the art, the restriction to flow of a capillary tube tends to vary depending on its dimensional characteristics (usually fixed) and depending on the temperature (usually variable) at which said capillary tube is exposed, whether the temperature of the refrigerant that circulate around there, or by an external heat source. In general, the hotter the temperature of exposure, the greater the restriction of the capillary tube.

Thus, returning to refer to FIG. 1, if, for example, the first evaporator PEVAP suffers a great increase of the thermal load (when applied to a refrigerator, when it receives hot or equivalent food), it is normal to occur rise in temperature of the refrigerant exiting the evaporator.

Whereas the first internal heat exchanger PTCI is substantially linked to the temperature of the refrigerant exiting the evaporator, it is expected the heating of the refrigerant flowing in the first expansion device PDE. Consequently, it is expected the increased restriction to flow in said first PDE expansion device.

The increasing restriction to the flow of said first expansion device PDE, due to the increase in its exposure temperature, generates two major interrelated problems, which: (I) The gradual reduction of the supply fluid coolant first evaporator PEVAP triggered by gradually increasing restriction to flow of the first PDE expansion device; and (II) the gradual superloading of refrigerant from the second evaporator SEVAP triggered by cooling the second expansion device SDE caused by excess refrigerant that does not reach the first evaporator.

These conditions are illustrated schematically in FIG. 2, which illustrates comparative graphs of the temperature of the internal heat exchangers and STCI PTCI, and restricting the expansion devices (capillaries) PDE and EDS. As you can see, from the introduction of heat load (time A) in the first compartment evaporator PEVAP the overheating increases, forcing the temperature increase of the first internal heat exchanger PTCI. Consequently, the restriction of the first PDE expansion device increases, forcing the coolant transfer to the second evaporator SEVAP. The second evaporator SEVAP tends to be superloaded characteristic in which the liquid front moves beyond the outlet of the evaporator flooding the second internal heat exchanger STCI and forcing reducing its temperature. Consequently, the restriction of the second expansion device SDE decreases, increasing the transfer of refrigerant to the second evaporator SEVAP and consequently increasing overheating the first evaporator PEVAP due to lack of coolant.

In other words: If one of the evaporators "warm" due to its increased thermal load, it is likely that this same evaporator stop being fed and in return, it is likely that the other evaporator is superloaded. All this occurs due to the redistribution of refrigerant that occurs between the evaporation lines due to the interaction between the outlet temperature of the evaporator and the internal heat exchanger.

Due to the variation restriction of the expansion device, the cooling capacity of both evaporators are compromised affecting the temperature of the compartments. In the case of the system illustrated in FIG. 1, the temperature of the first evaporator PEVAP increases because the large restriction to the first PDE expansion device imposes an evaporator drying forcing the fall of heat exchange effectiveness, drastically reducing its capacity. In turn, the reduction of the second expansion device SDE restriction requires an increase in the evaporating temperature and, in turn, increase the compartment temperature.

The present prior art does not include any technical solution aimed to solve the problem, and is based on this scenario that arises the invention in question.

OBJECTIVES OF THE INVENTION

It is therefore one of the objects of the invention in question reveal a multiple evaporation cooling system, even including internal heat exchangers, is free of the above discussed problems arising from the demands cooling variables.

More particularly, it is one objective of the invention to provide a multiple-evaporation cooling system which, through passive and automatic means, is able to harmonize and equalize the flow of refrigerant in the evaporator when one of these is subjected to an unexpected cooling demand.

SUMMARY OF THE INVENTION

All the aims of the subject invention are achieved by means of a multiple evaporative cooling system, which comprises at least one compressing arrangement (reciprocating compressor provided with at least two suction pathways or at least two conventional reciprocating compressor connected in parallel so as to define at least two suction paths) able to operate in at least two separate evaporation lines, the first line evaporation comprised of at least one expansion device, at least one evaporator and at least one heat exchanger intermediate heat, and the second line evaporation comprised of at least one expansion device, at least one evaporator and at least one intermediate heat exchanger.

In more, there is still the expansion device and the intermediate heat exchanger of the first line evaporation comprising a single capillary tube and the expansion device and the intermediate heat exchanger of the second evaporation line comprising a same capillary tube.

In accordance with the subject invention, the intermediate heat exchanger of first evaporation line comprises at least one expansion device segment physically disposed in contact with at least a portion of the second row of evaporation (preferably with the portions of the second evaporative line defined between the evaporator and the suction inlet of the compressor fluid). Moreover, the intermediate heat exchanger's second evaporation line comprises at least a segment of the physically arranged expansion device in contact with at least a first evaporation line portion (preferably with the first evaporative line segment defined between the evaporator and the suction inlet of the compressor fluid).

Thus, it is emphasized that, according to the invention in question, said intermediate heat exchanger of the first evaporation line is able to exchange heat only with the second row of evaporation, and the intermediate heat exchanger second evaporation line is able to exchange heat exclusively with the first evaporation line.

This means that the temperature of the intermediate heat exchanger of first evaporation line influences the temperature of the refrigerant flowing into the expansion device of the second evaporation line and the temperature of the intermediate heat exchanger of the second evaporative line influences temperature of the refrigerant flowing into the expansion device of the first evaporation line to inhibit improper mass transfer of refrigerant between at least two separate evaporation lines.

BRIEF DESCRIPTION OF THE DRAWINGS

The present invention is now detailed in detail based on the figures listed, including.

DETAILED DESCRIPTION OF THE INVENTION

In accordance with the subject invention, disclosed is a multi-evaporation cooling system whose equalization or balancing of capacities and efficiencies of the evaporators, even in situations where only one of the evaporators is subjected to extra demand cooling (heating evaporator), occurs automatically and steadily. Therefore, the general idea is "cross" the internal heat exchanger, i.e., using the internal heat exchanger of an evaporating cooling line to another evaporation line, and vice versa.

Figure 3A:
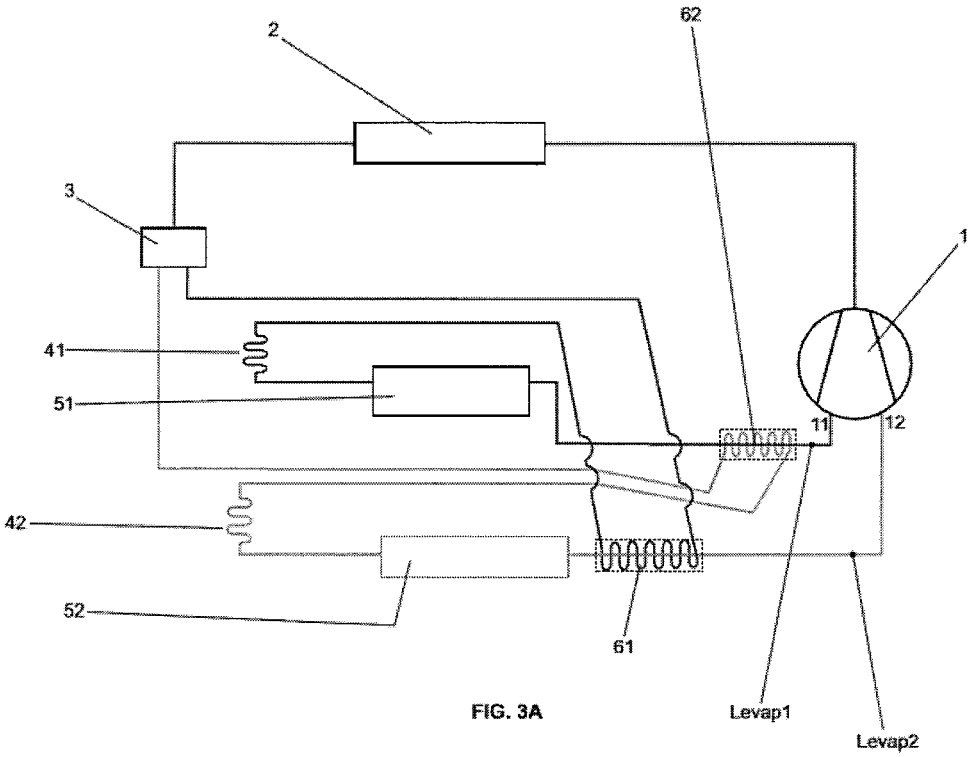
FIGS. 3A and 3B illustrate schematically possible embodiments of the multi-evaporation cooling system according to the present invention.
Figure 3B:
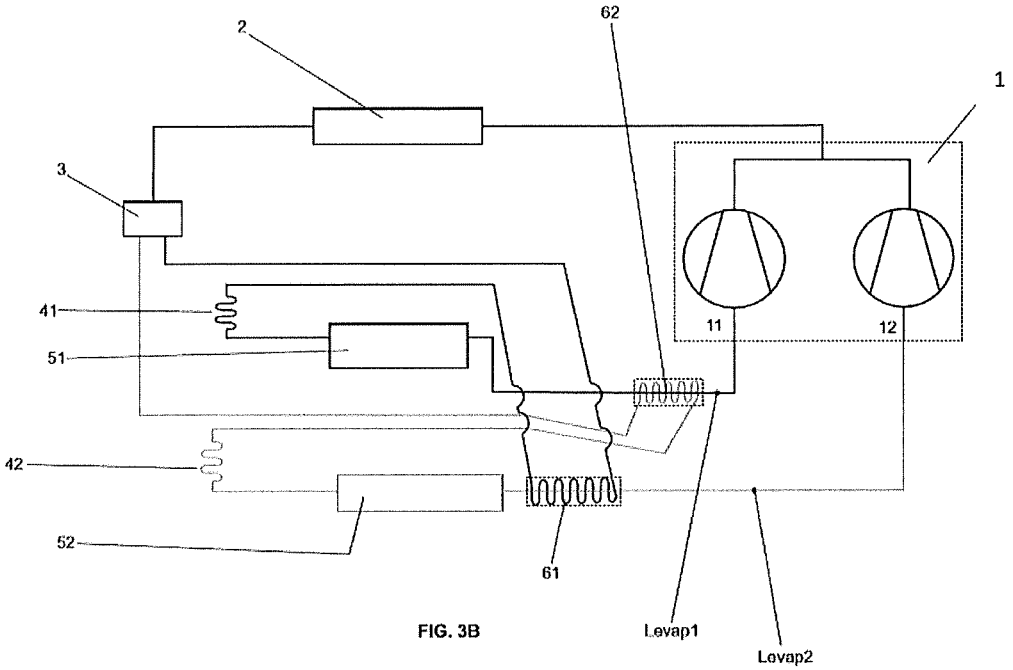

The present invention becomes more clear through observation of FIGS. 3A and 3B, which illustrate, both the multi-evaporation cooling system with internal heat exchangers "crossed".

As schematically illustrated in FIGS. 3A and 3B, the multiple evaporation cooling system according to the present invention comprises a skilled first compressing arrangement to operate with two distinct evaporation lines Levap1 and Levap2.

In FIG. 3A, the compression arrangement 1 comprises a reciprocating compressor provided with at least two suction paths 11 and 12. An example of this type of compressor is described in detail in PCT/BR2011/000120. In FIG. 3B, the compression arrangement 1 comprises two conventional reciprocating compressors connected in parallel so as to define at least two suction paths 11 and 12.

Thus, and in accordance with the illustrated preferred embodiments, said compression arrangement 1 comprises two separate inputs suction 11 and 12, wherein the suction inlet 11 is uniquely connected to Levap1 evaporation line and the input suction 12 is exclusively connected to Levap2 evaporation line.

It is also worth noting that although the preferred embodiment of the invention in question envisages only two evaporation lines (and a compressor with only two suction inlets), the general concept herein disclosed is considered valid for multiple evaporation lines (and one or more compressors with two or more suction inlets).

The now treated multi evaporation cooling system further comprises a condenser 2, a feeder 3 of the evaporator lines and the evaporation lines Levap1 and Levap2 themselves.

In general lines, the first line Levap1 evaporation comprises an expansion device 41, evaporator 51 and one intermediate heat exchanger 61. The second evaporation Levap2 line comprises, in turn, an expansion device 42, one evaporator 52 and a heat exchanger intermediate 62.

Preferably, and as occurs in the prior art, both the expansion device 41 and the Intermediate heat exchanger 61, and the expansion device 42 and the intermediate heat exchanger 62, comprise each arrangement, a capillary tube.

This means that, according to the preferred embodiment of the invention in question, intermediate heat exchangers 61 and 62 comprise segments of capillary tubes capable of being placed in contact with suction line (external side contact or concentrically within the pipe).

Figure 1:
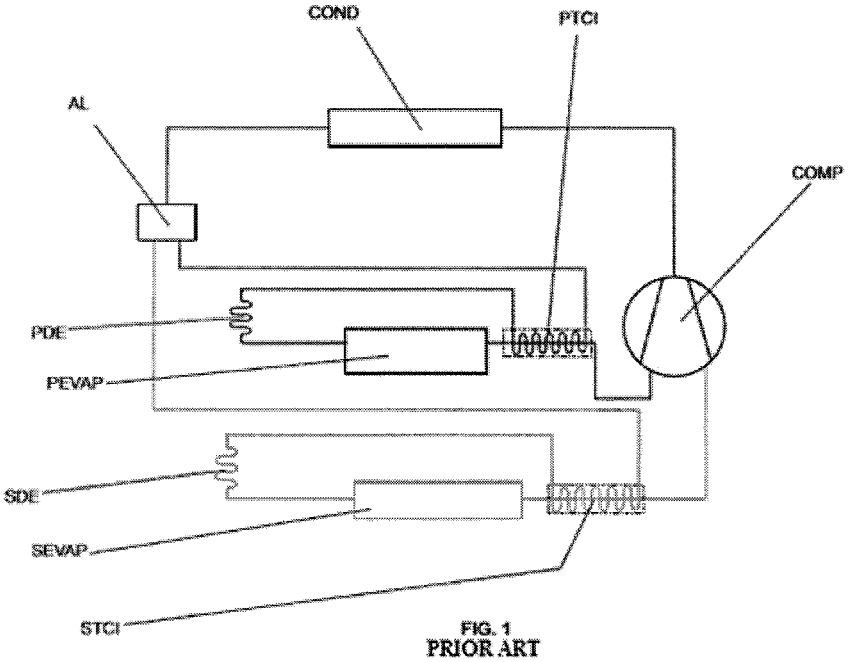
FIG. 1 PRIOR ART
FIG. 1 illustrates schematically a multi-evaporation cooling system pertaining to the current state of the art.
Figure 2:
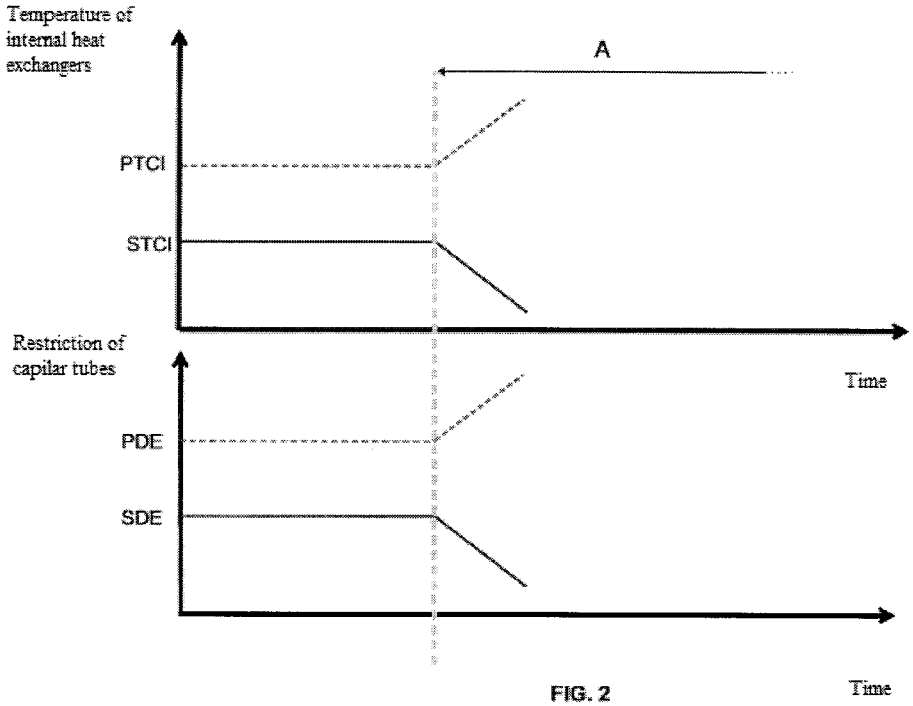
FIG. 2 PRIOR ART
FIG. 2 illustrates graphs related to multi-evaporation cooling system illustrated in FIG. 1, in a situation where the first evaporator is increased thermal load.

Differently from what occurs in multi-evaporation cooling system pertaining to the current state of the art, as exemplified in FIG. 1, multiple evaporation cooling system disclosed in the present invention and schematically illustrated in FIG. 3, comprises a general scheme differentiated.

In this differential scheme, the heat exchanger Intermediate 61, originating in the first line Levap1 evaporation, is formed by a segment of capillary tube 41 physically arranged in Levap2 evaporation line (external side contact or concentrically inside the tube), between the evaporator 52 and the suction inlet 12 of the first compressing arrangement.

In more, the heat exchanger Intermediate 62 originating the second line Levap2 evaporation, is formed by the capillary tube segment 42 physically arranged in Levap1 evaporation line (external side contact or concentrically inside the tube), between evaporator 51 and the suction inlet 11 of the first compressing arrangement.

This arrangement "crossed" causes the Levap1 evaporation line influences the temperature of the refrigerant flowing in the expansion device 42 through the internal heat exchanger 62, the true reciprocal is, this is the Levap2 evaporation line in turn, influences the temperature of the refrigerant flowing in the expansion device 41 through the internal heat exchanger 61.

This arrangement is extremely important to avoid imbalance or unbalancing and efficiency of the evaporators in situations when one of these suffers a high demand for cooling.

Figure 4:
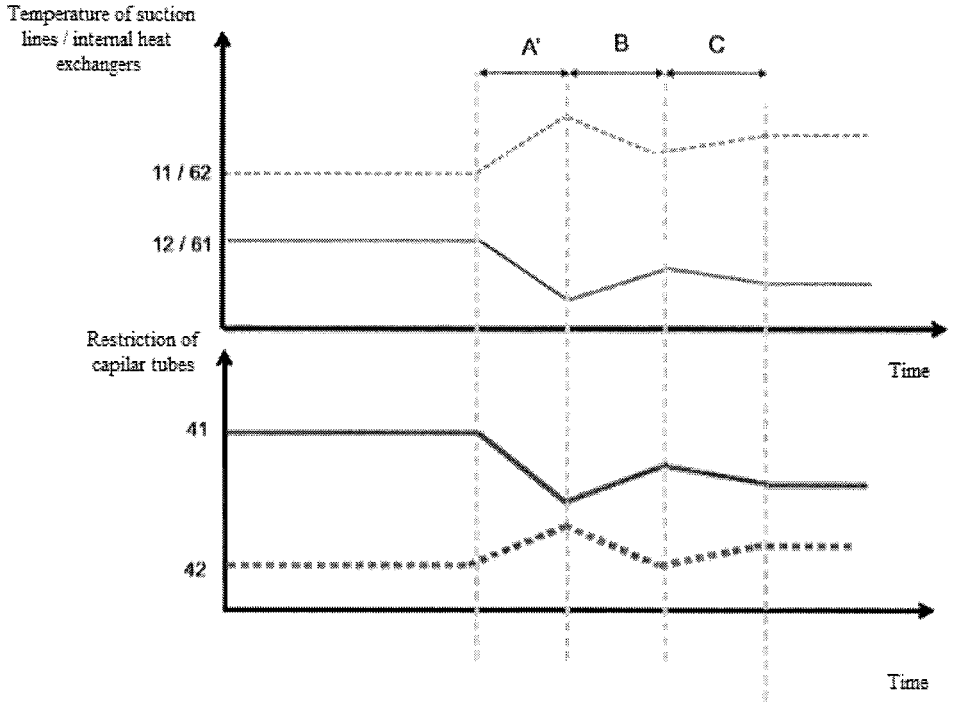
FIG. 4 illustrates graphs related to multi-evaporation cooling system illustrated in FIG. 3, in a situation where the first evaporator is increased thermal load.

The functional principle, which is automatic and constant, even liability can be explained by considering a hypothetical situation on cooling demand in the evaporator 51, i.e., a hypothetical situation where the evaporator 51 is heated and needs to be cold, as illustrated in FIG. 4.

In this case, the evaporator 51 first overheats due to the thermal load generating on cooling demand (see time interval A 'in FIG. 4) increasing the temperature of the refrigerant flowing between its output and input 11 of the suction compressing arrangement 1 (suction line) and thus increasing the exposure temperature of the intermediate heat exchanger 62. in turn, the superloading trend of the evaporator 52 due to mass displacement refrigerant from the evaporator 51, tends to cool the refrigerant flowing between its outlet and inlet 12 of the suction of compressor arrangement 1 (suction line) and hence reducing the exposure temperature of the intermediate heat exchanger 61.

This means that the elevation 62 of the intermediate heat exchanger temperature increases the restriction of the expansion device 42 of the second line Levap2 evaporation, making it difficult for the fluid coolant over the evaporator 51 is transferred to the evaporator 52. In turn, at low temperature obtained in the internal heat exchanger 61 reduces the restriction of the expansion device 61 of the first evaporation Levap1 line providing an increased flow rate in the circuit.

Accordingly, the less refrigerant to the evaporator 52 is, the greater the amount of refrigerant remaining in the evaporator 51, which tends to be cooled more rapidly recovering its cooling capacity.

In any case, and considering that the evaporator 51 does not suffer from lack of food, it is expected that it becomes to operate with temperature at nominal operation (see intervals B and C in FIG. 4).

This combination of effects occurs automatically, arrangement according to the "cross" or "inverted" internal heat exchangers, inhibits unwanted coolant mass transfer (that originally would occur) the first Levap1 evaporation line for the second evaporation line Levap2 (in this example, but applies also to the opposing action of the evaporator 52 is subjected to a high thermal load).

The invention claimed is:

1. A multi-evaporation cooling system, comprising:

a reciprocating compressor (1) provided with two suction paths coupled to two distinct evaporation lines (Levap 1, Levap 2); wherein the first evaporation line (Levap 1) comprises a first expansion device (41), a first evaporator (51) and a first intermediate heat exchanger (61);

the second evaporation line (Levap 2) comprises a second expansion device (42), a second evaporator (52) and a second intermediate heat exchanger (62);

said multi-evaporative cooling system being characterized by the fact that:

the first intermediate heat exchanger (61) of the first evaporation line (Levap 1) comprises a first segment of the first expansion device (41) physically disposed in contact with a portion of the second evaporation line (Levap 2), downstream of said second evaporator and upstream of a suction inlet of the reciprocating compressor (1);

the second intermediate heat exchanger (62) of the second evaporation line (Levap 2) comprises a first segment of the second expansion device (42) physically disposed in contact with a portion of the first evaporation line (Levap 1) downstream of said first evaporator (51) and upstream of the suction inlet of the reciprocating compressor (1); and in that said first segment of the first expansion device (41) in the first intermediate heat exchanger (61) comprises a same capillary tube as a second segment of the first expansion device (41) arranged downstream of said first segment of the first expansion device (41) and upstream of said first evaporator (51);

said first segment of the second expansion device (42) in the second intermediate heat exchanger (62) comprises a same capillary tube as a second segment of the second expansion device (42) arranged downstream of said first segment of the second expansion device (42) and upstream of said second evaporator (52);

wherein the first segment of the first expansion device of the first evaporation line is individually and fluidically isolated from the first segment of the second expansion device of the second evaporation line.

2. The multi-evaporation cooling system, according to claim 1, characterized by the fact that said reciprocating compressor (1) comprises a reciprocating compressor having at least two suction ways (11, 12).

3. The multi-evaporation cooling system, according to claim 1, characterized by the fact that said reciprocating compressor (1) comprises at least two reciprocating compressors associated in parallel in a way to define at least two suction ways (11, 12).

* * * * *